US005614265A

United States Patent [19]

Chaudhry et al.

[11] Patent Number: 5,614,265

[45] Date of Patent: *Mar. 25, 1997

[54] IN-LINE COATING OF STEEL TUBING

[75] Inventors: Manzoor A. Chaudhry, Bensalem, Pa.; Jeffrey L. Lamber, Richton Park, Ill.; Bruce E. Laumann, Crown Point, Ind.; Edward E. Mild, Frankfort; Brian G. Muick, Country Club Hills, both of Ill.; Stephen T. Norvilas, Doylestown; David S. Pliner, Huntingdon Valley, both of Pa.; Stephen E. Seilheimer, Homewood, Ill.

[73] Assignee: Allied Tube & Conduit Corporation, Harvey, Ill.

[ * ] Notice: The term of this patent shall not extend beyond the expiration date of Pat. No. 5,453,302.

[21] Appl. No.: 388,972

[22] Filed: Feb. 14, 1995

Related U.S. Application Data

[63] Continuation-in-part of Ser. No. 243,583, May 16, 1994, Pat. No. 5,453,302.

[51] Int. Cl.[6] ..... B05D 1/18

[52] U.S. Cl. ..... 427/430.1; 427/348; 427/350; 118/50; 118/63; 118/64; 118/65; 118/68; 118/404; 118/405; 118/410; 118/419; 118/421; 118/602; 118/603; 118/610; 118/DIG. 11; 118/DIG. 12; 118/DIG. 13

[58] Field of Search ..... 427/430.1, 348, 427/350; 118/50, 63–65, 68, 404, 405, 410, 419, 421, 602, 603, 610, DIG. 11, DIG. 12, DIG. 13

[56] References Cited

U.S. PATENT DOCUMENTS

| | | | |
|---|---|---|---|
| 3,281,918 | 11/1966 | Leib et al. | 29/33 F |
| 3,908,593 | 9/1975 | Rossi et al. | 118/620 |
| 3,978,815 | 9/1976 | Carrara | 118/69 |
| 5,286,294 | 2/1994 | Ebi et al. | 118/667 |
| 5,453,302 | 9/1995 | Chaudhry et al. | 427/430.1 |

FOREIGN PATENT DOCUMENTS

| | | |
|---|---|---|
| 534171 | 2/1941 | United Kingdom . |
| 637538 | 5/1950 | United Kingdom . |

*Primary Examiner*—Shrive Beck
*Assistant Examiner*—David M. Maiorana
*Attorney, Agent, or Firm*—Banner & Witcoff, Ltd.

[57] ABSTRACT

A method and apparatus for applying a coating to a continuous length of tubing. A coating chamber having entry and exit ports substantially encloses a portion of the tubing while permitting the tubing to pass continuously therethrough. Airflow into the coating chamber through the exit port strips excess coating material from the tubing surface. Air is withdrawn from the coating chamber by vacuum pumps through one or more separation chambers which separate entrained particles or droplets of coating material from the air. The coating chamber is preferably disposed at a distance from the separation chamber(s). The vacuum line connecting the coating chamber with the separation chamber(s) is preferably flexible or breakable. The separation chambers are preferably capable of being operated in series or in parallel. Adjustable masks are preferably provided at the entry and exit ports of the coating chamber. A seal is preferably provided at the entry port.

28 Claims, 9 Drawing Sheets

2/9

3/9

IN-LINE COATING OF STEEL TUBING

RELATED APPLICATION

This is a continuation-in-part of U.S. application Ser. No. 08/243,583 entitled "In-Line Coating Of Steel Tubing" filed May 16, 1994, now U.S. Pat. No. 5,453302 and assigned to the same assignee as the present application.

BACKGROUND OF THE INVENTION

The invention relates generally to continuous manufacture of steel tubing, and relates more particularly to finishing operations.

Due to its susceptibility to corrosion, steel tubing is often coated with one or more layers of protective materials. For example, steel tubing may be galvanized by application of molten zinc, or may be coated with various other paints or coating materials, alone or in combination. It has long been known in the art that significant economies may be realized by applying coatings to the tubing in line with manufacture thereof, rather than applying coating materials in separate operations after the tubing has been cut to length. (See, e.g., co-pending application Ser. No. 08/026,432 now U.S. Pat. No. 5,453,302 and assigned to the same assignee as the present application.)

A problem which arises in connection with in-line coating of steel tubing is that coating thickness is often difficult to control at production speeds. Air knives have been employed to blow excess coating material from the tubing, but air knives do not permit a great deal of precision to be maintained in regulating coating thickness.

Typically, coating processes require that coating thickness not fall below a minimum value needed for adequate protection of the substrate. Maximum permissible thickness may be a function of cost. That is, excessive thickness represents waste of coating material. Also, excessive thickness may make the product unacceptable by leaving visible irregularities on the product surface due to running of coating material, or by leading to insufficient drying or curing of the coating within the time available.

It is a general object of the invention to provide an improved method and apparatus for in-line coating of steel tubing to provide improved control of coating thickness.

SUMMARY OF THE INVENTION

The invention generally relates to a method and apparatus for applying liquid coating material to metal tubing in a coating chamber in-line with formation of the metal tubing, wherein coating thickness is regulated by controlled flow of air into the coating chamber about the exterior of the tubing as the tubing exits the coating chamber. The coating chamber is connected to a vacuum/supply system which supplies coating material to the coating chamber through a supply line and draws air from the coating chamber through a vacuum line into a separation chamber where entrained particles or droplets of coating material are separated from the airstream.

In accordance with a feature of the invention, the coating chamber is spaced from the vacuum/supply system, and the vacuum line is flexible or breakable so that the coating chamber can move relative to the separation chamber or break away therefrom in the event of major transverse displacements of the steel tubing due to fold-ups or other mishaps. In contrast to prior art vacuum coating equipment in which a coating chamber has been attached directly to a separation chamber and in close proximity to other system components, the system of the invention enables damage to be avoided entirely or limited to the coating chamber in the event of large displacements of the metal tubing.

According to another feature of the invention, separate separation chambers on separate bases are provided in order to further reduce the risk of damage in the event the tubing is accidentally displaced from its normal path.

In one embodiment of the invention, each vacuum/supply system includes two separation chambers which are capable of functioning independently of one another, and which may be connected in parallel with one another so that one chamber may be taken off-line for maintenance while the other continues to function, without interruption of coating operations.

To facilitate positioning of the coating chamber during set-up, the coating chamber is preferably supported on an adjustable stand which enables control of both the elevation and the attitude of the coating chamber.

The invention also preferably permits rapid changeover from one coating material to another. To this end, the preferred apparatus includes at least two independent vacuum/supply systems. In accordance with a preferred method of operation, changing the coating operation from one coating material to another is accomplished by disconnecting the coating chamber from one vacuum/supply system, flushing the coating chamber and any lines that remain connected thereto, and then connecting the coating chamber to another vacuum/supply system. The coating chamber remains in place on the tubing line throughout the changeover to minimize line down time. The supply line and the vacuum line are preferably both provided with quick-disconnect fittings or other means to facilitate connection and disconnection of the coating chamber to and from the respective vacuum/supply systems. The vacuum/supply systems are preferably movable and positioned side-by-side. The vacuum ports on the respective systems are preferably positioned adjacent one another to reduce the distance that the respective units must be moved during changeovers.

According to another feature of the invention, a guide assembly enables the coating chamber to follow the movement of the tubing in a vertical plane during coating of the tubing. The guide assembly carries the coating chamber during accidental displacement of the tubing to a location remote from its normal path so that damage to the separation chambers and coating chamber is minimized.

Preferably, the guide assembly comprises a coating chamber base for supporting the coating chamber. Springs are supported on the coating chamber base and are coupled to the coating chamber for counterbalancing the weight of the coating chamber. Rollers are coupled to the coating chamber for engaging the tubing and for moving the springs in response to movement of the tubing. Fasteners releasably connect the springs to the base. The fasteners enable the coating chamber to move with the tubing during accidental displacement of the tubing to a location remote from the normal path of the tubing.

By using the foregoing techniques, tubing may be coated with a degree of safety and reliability unavailable with the known prior techniques.

BRIEF DESCRIPTION OF THE DRAWINGS

The preferred embodiments are shown for purposes of illustration but not of limitation in connection with the following drawings wherein like numbers refer to like parts throughout and wherein.

DETAILED DESCRIPTION OF PREFERRED EMBODIMENTS

Figure 1:
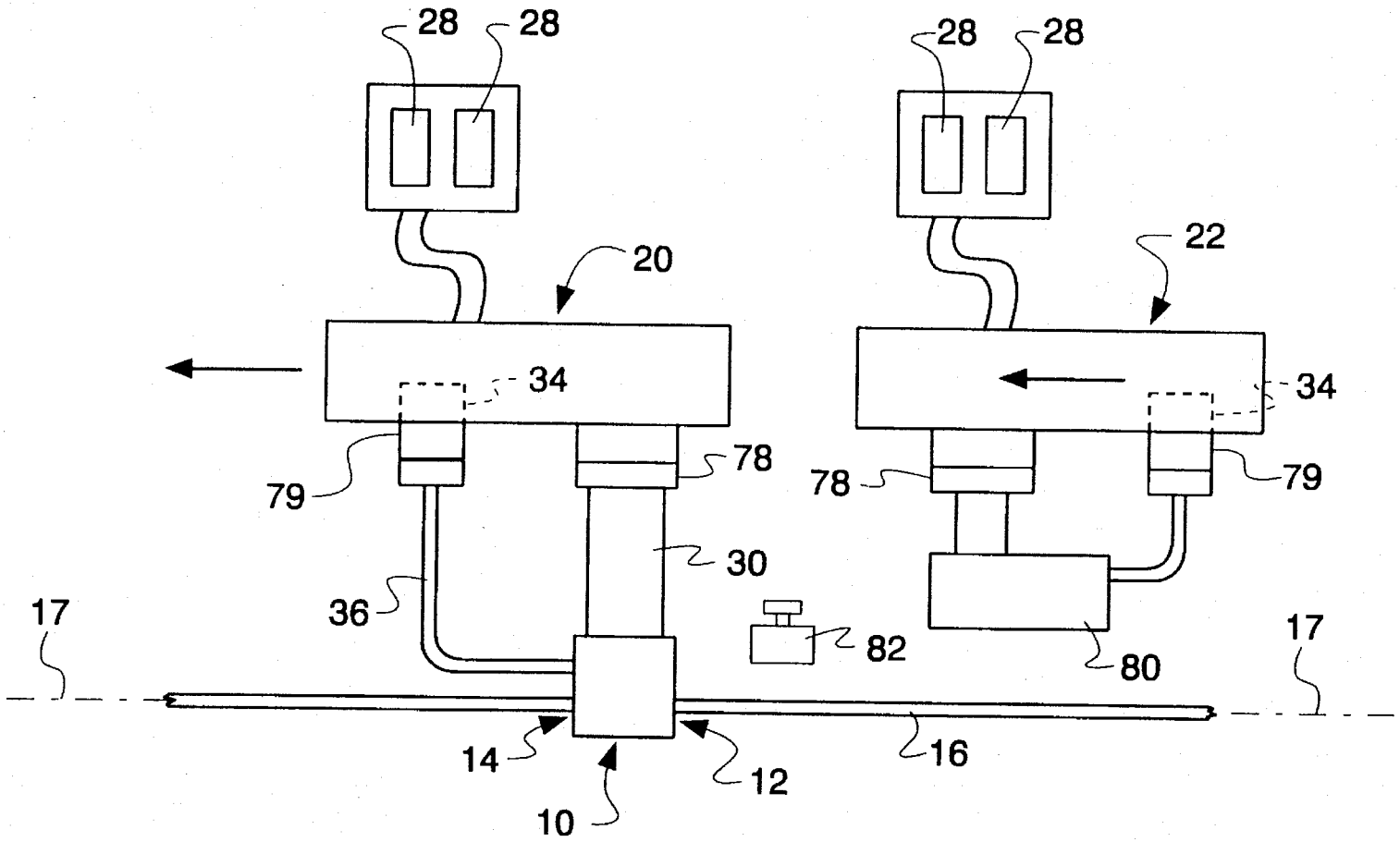
FIG. 1 is a diagrammatic plan view of coating apparatus in accordance with a preferred aspect of the invention.
Figure 2:
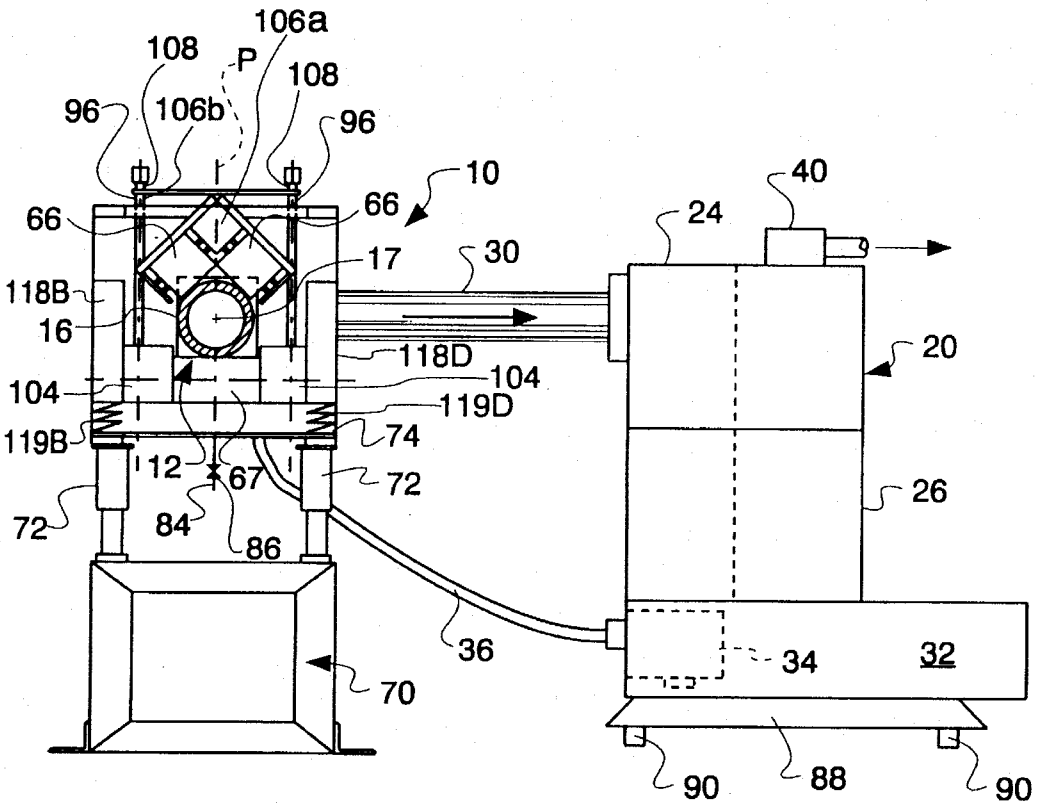
FIG. 2 is a diagrammatic side elevational view of a portion of the apparatus shown in FIG. 1.
Figure 6:
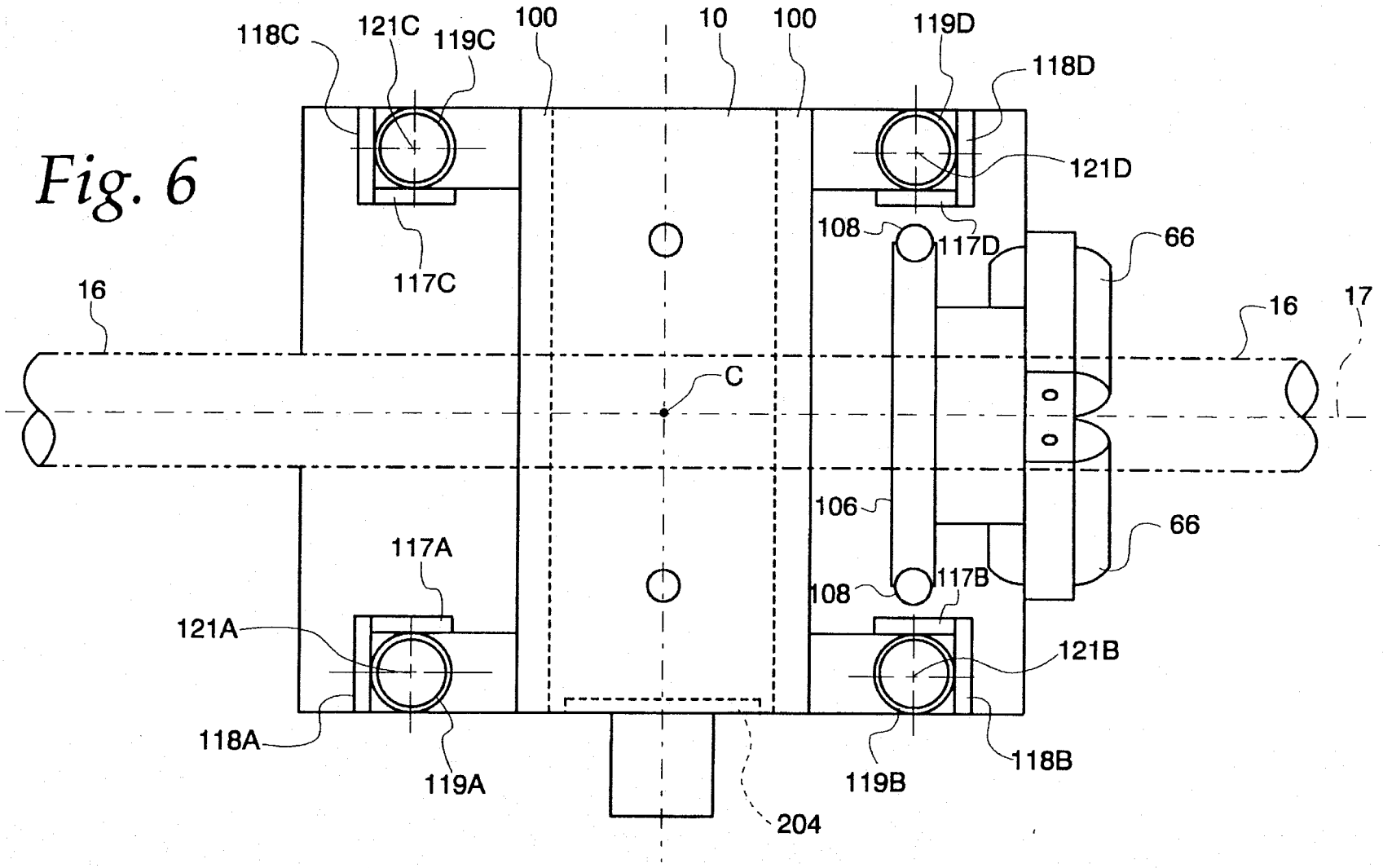
FIG. 6 is a diagrammatic plan view of the apparatus shown in FIG. 3A.
Figure 7:
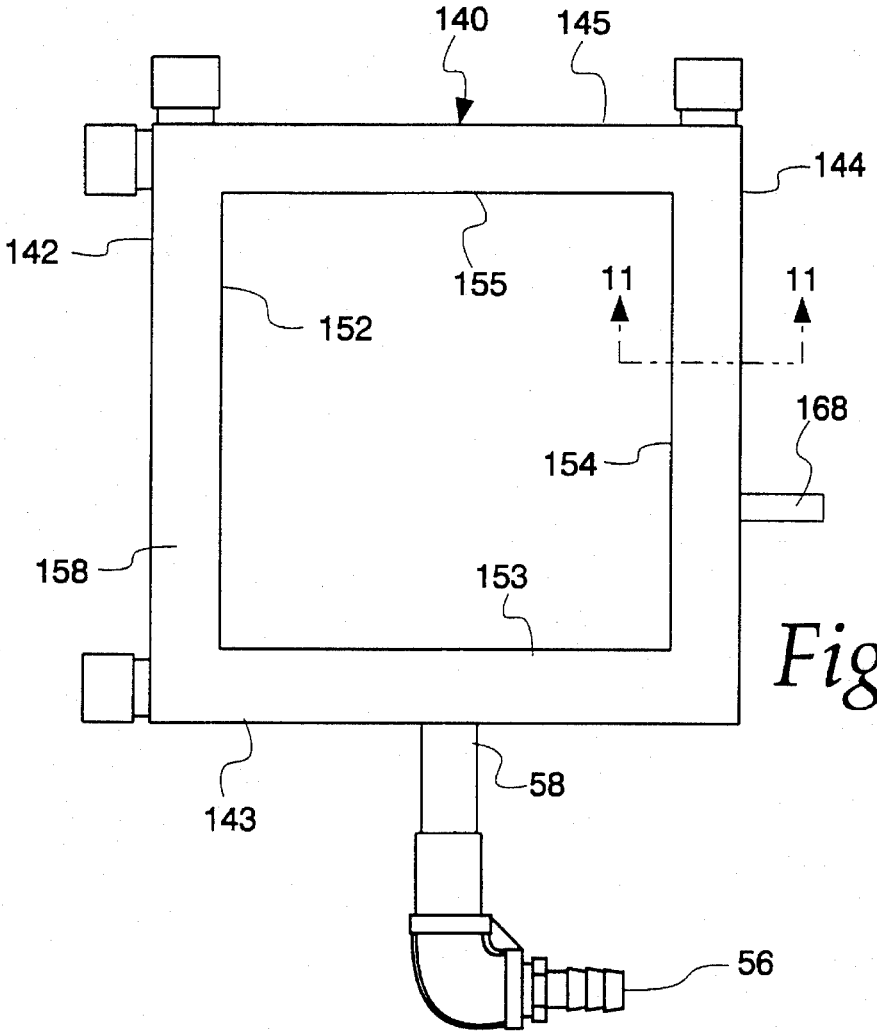
FIG. 7 is a side elevational view of the coating applicator shown schematically in FIG. 3A.
Figure 8:
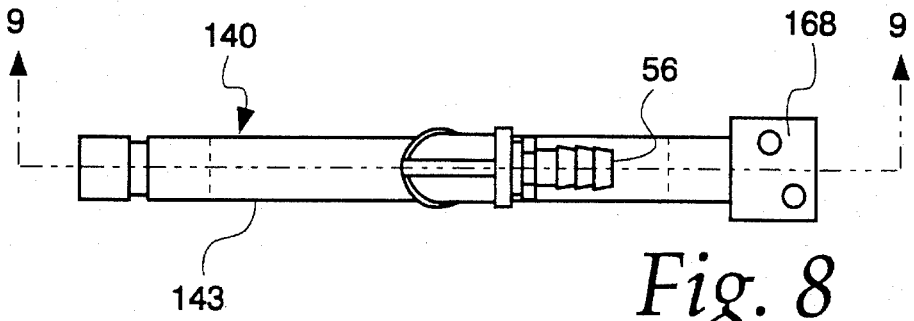
FIG. 8 is a bottom plan view of the applicator shown in FIG. 7.

Referring to FIGS. 1–3A, the invention is generally embodied in a method and apparatus for applying a coating to a continuous length of steel tubing 16 that is moved along a linear path 17 concentric with tubing 16 that defines a vertical plane P (FIGS. 1 and 2). The tubing is moved a speeds in the range of 80 to 900 feet per minute. The tubing may have a diameter in the range of ½ to 5 inches, but is not limited to round shapes. The apparatus includes a coating chamber 10 for substantially enclosing a portion of the tubing while permitting the tubing to pass continuously through an entry port 12 and exit port 14 which are disposed at opposite ends of the coating chamber. Chamber 10 includes a top plate 11 (FIG. 3A) and defines a central vertical axis C (FIG. 6). Liquid coating material is flooded onto the tubing in the coating chamber.

The apparatus further comprises one or more vacuum/supply systems for supplying coating material to the coating chamber in liquid phase, and withdrawing air with particles or droplets of coating material entrained therein to maintain the chamber interior at subatmospheric pressure. FIG. 1 illustrates two vacuum/supply systems 20, 22 disposed side-by-side.

Airflow into the coating chamber 10 through the exit port strips excess coating material from the tubing surface and carries it back into the chamber interior. Coating thickness may be controlled by regulating velocity of airflow and vacuum.

In the illustrated embodiment, each vacuum/supply system comprises first and second separation chambers 24 and 26 (FIG. 2), wherein particles of liquid coating material are separated from the air withdrawn from the coating chamber, and a pair of vacuum pumps 28 to draw air through the separation chambers from the coating chamber 10. The separation chambers 24 and 26 are connected to the coating chamber by a vacuum line 30.

Liquid coating material is supplied to the coating chamber 10 from a reservoir 32 in the vacuum/supply unit by a supply pump 34 which effects flow of coating material through a supply line 36 from the reservoir 32 to the coating chamber 10.

A problem with may be encountered in any operation in-line with manufacture of a length of continuous steel tubing is that a major displacement known as a "fold-up" may occur, wherein a portion of the length of tubing is folded or bent out of the linear straight axis due to a downstream stoppage of travel. The tubing is typically supported from below by rollers along most of its length. Accordingly, a fold-up typically results in the affected portion being displaced substantially upward or sideward or out of lineal axis 17. To minimize damage to components of the coating system in the event of such mishaps, the coating chamber 10 is preferably spaced from the vacuum/supply system, and the vacuum line 30 is flexible or breakable so that the coating chamber 10 can move relative to the separation chamber 26 or break away therefrom in the event of a major displacement of the steel tubing.

Supply line 36 which carries coating material to the coating chamber is, like the vacuum line, preferably of a flexible or breakable construction as well. The supply line may comprise a flexible hose.

A control system is preferably provided to sense fold-ups and to stop pumping of liquid coating material in response thereto. To this end, a limit switch may be positioned above the length of tubing 16 near the coating chamber to detect major upward displacements.

In the illustrated embodiment of FIGS. 1 and 2, in each vacuum/supply system the separation chambers 24 and 26 are positioned side-by-side and are capable of functioning independently of one another. Preferably, the separation chambers 24 and 26 are normally connected in series for optimal removal of entrained coating material from the air being drawn therethrough. To permit maintenance to take place on one of the separation chambers without interrupting coating operations, the chambers 24 and 26 are also capable of being connected in parallel with one another so that one chamber may be taken off-line for maintenance while the other continues to function.

Figure 5:
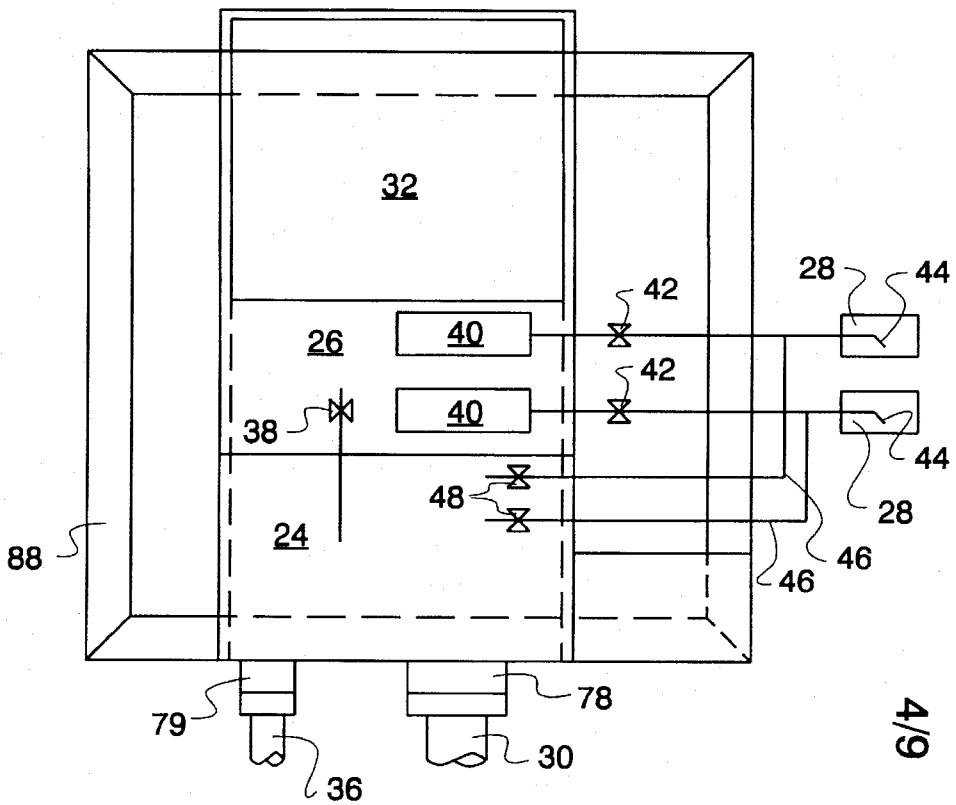
FIG. 5 is a diagrammatic plan view of a portion of the apparatus shown in FIG. 1.
Figure 4:
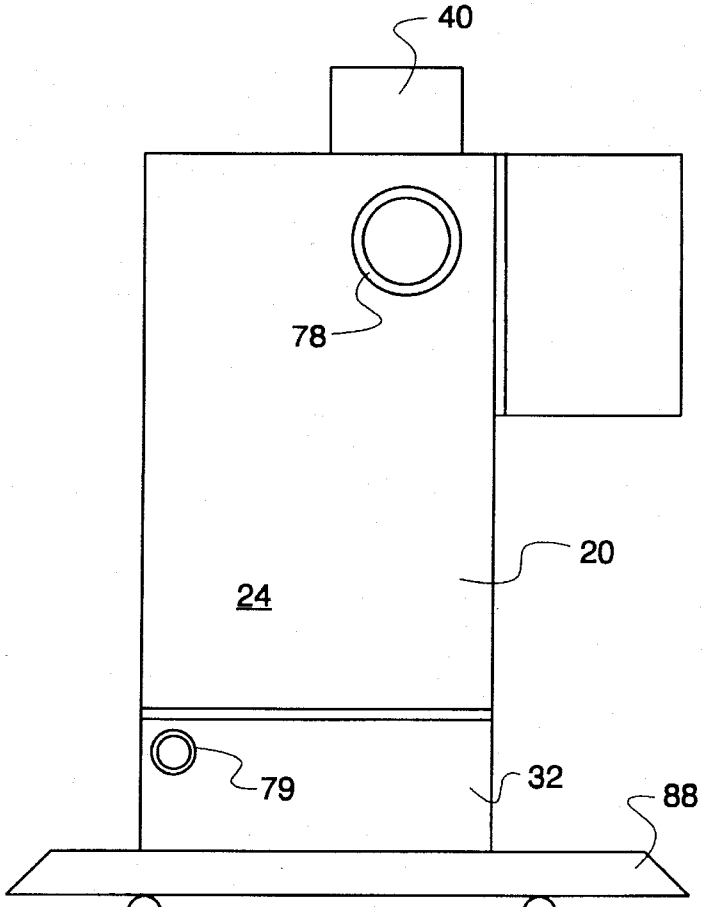
FIG. 4 is a diagrammatic front elevational view of a portion of the apparatus shown in FIG. 1.

In the illustrated embodiment of FIGS. 2 and 5, during normal operation, air flows from the coating chamber 10 through the vacuum line 30 into the first separation chamber 24, then through a pair of parallel valves 38 into the second separation chamber 26, then through a pair of parallel filters 40 disposed atop the second separation chamber 26, and from there through a second pair of parallel valves 42 disposed shortly downstream of the filters, to the inlets 44 (FIG. 5) of the vacuum pumps 28. However, air may also flow directly from the first separation chamber 24 to the pump inlets 44 through a pair of bypass vacuum lines 46 which are normally closed by a third pair of parallel valves 48.

When it is desired to service the filters 40, the third pair of valves 48 are opened, and the first and second pairs of valves 38 and 42 are closed. Air is thus shunted directly from the first separation chamber 24 to the vacuum pumps, bypassing the second separation chamber 26.

The separation chambers 24 and 26 in the illustrated embodiment are disposed over the reservoir 32 containing the liquid coating material.

The coating chamber 10, as noted above, has entry and exit ports 12 and 14 through which the continuous length of tubing passes. A seal 50 is preferably provided at the entry port 12 to engage the exterior surface of the tubing and minimize airflow into the coating chamber through the entry port. The seal is preferably made of a flexible material and may, for example, be made of a suitable fabric or elastomer or paperboard. The seal 50 preferably contacts the exterior of the tubing about its entire periphery to effect a wiping action thereagainst.

The seal 50 is preferably mounted on a mask 52 which is affixed to the entrance port. A similar mask 54 is provided at the exit port. Both masks are adjustable vertically and horizontally to enable fine-tuning of alignment after the coating chamber has been positioned as desired. The mask 54 at the exit port does not have a seal associated therewith. At the exit port, airflow into the coating chamber is desired to control the thickness of the coating, and clearance is accordingly provided between the mask 54 and the tubing exterior. The masks 52 and 54 are sized so as to have the same shape as the profile of the steel tubing passing therethrough, with sufficient clearance about the exterior of the tubing to avoid contact between the tubing and the masks. At the exit port, any such contact could adversely affect the coating.

Liquid coating material is supplied to the coating chamber 10 through an opening 56 in the coating chamber. The liquid coating material flows upward through a suitable supply pipe 58 in the interior of the coating chamber to an applicator 60 which applies the liquid coating material to the steel tubing. The position of the applicator may be adjustable, and to this end, an external mechanism may be provided to vary the position of the applicator 60 within the coating chamber 10. In one embodiment, the applicator is a ring which completely surrounds the steel tubing and floods liquid coating material onto the tubing exterior from all sides. In other embodiments, the applicator may take other forms. For example, the applicator may simply comprise a nozzle or opening at the end of the supply pipe positioned above the tubing to flood liquid coating material onto the top of the tubing.

To prevent spillage of excess liquid coating material, the apparatus preferably includes a control system which prevents the liquid supply pump from operating when the vacuum is not functioning. A basin may be provided beneath the coating chamber 10, and drain holes may be provided near the bottom of the coating chamber so that if liquid begins to accumulate in the coating chamber it will drain into the basin. The basin may be connected to a drain hose to carry excess liquid coating material to a suitable receptacle.

In the illustrated embodiment, the vacuum line 30 extends substantially horizontally from the side of the coating chamber at an elevation approximately halfway between the top and bottom of the coating chamber, and is positioned substantially perpendicular to the tubing.

Figure 3:
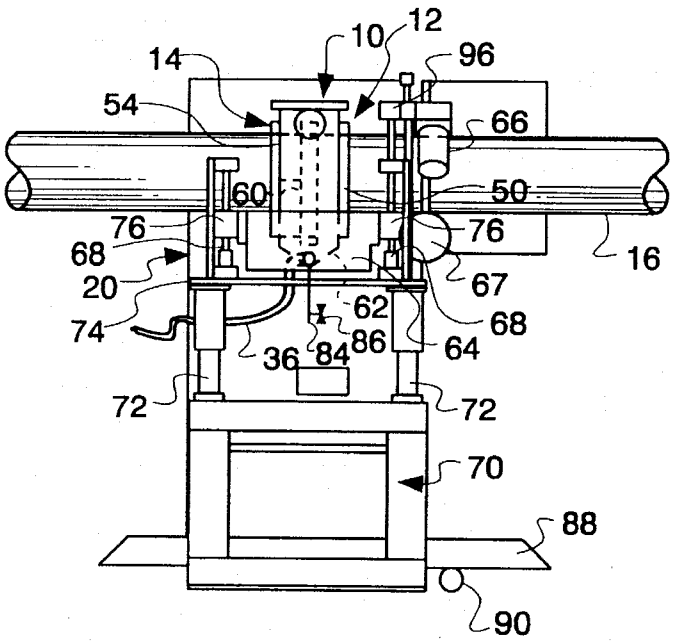
FIG. 3 is a diagrammatic front elevational view of a portion of the apparatus shown in FIG. 1.
Figure 3A:
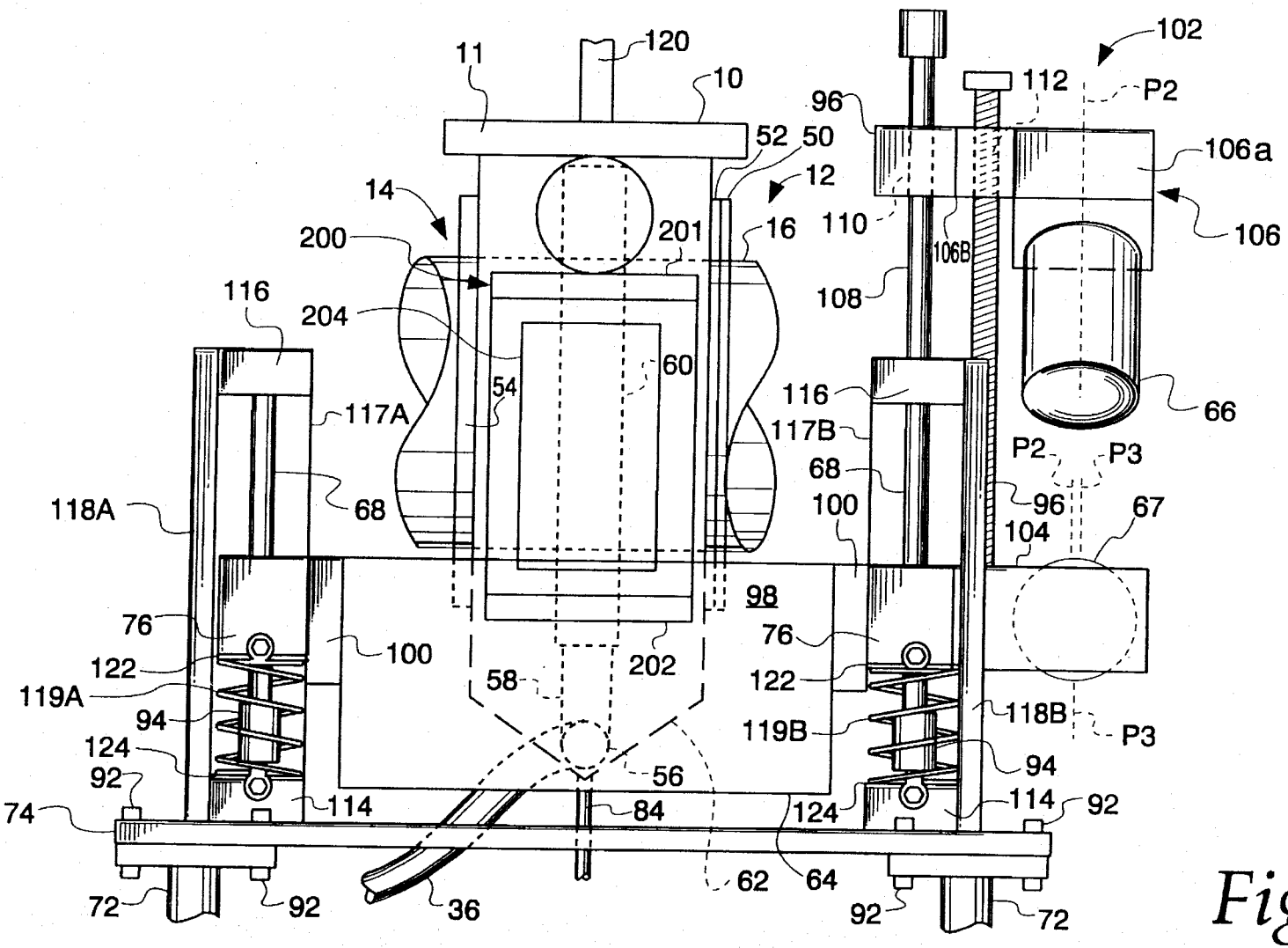
FIG. 3A is a diagrammatic front elevational view of a portion of FIG. 3, shown on an enlarged scale.

A problem which may arise in continuous operation is that, during normal operation, the tubing 16 may be subjected to small vertical displacements due to periodic impact loads on the tubing by a vertically traveling cutoff blade downstream from the coating apparatus. To maintain the coating chamber 10 properly positioned relative to the tubing, the coating chamber preferably rides on the tubing so that the coating chamber shifts slightly upward and downward in response to like displacement of the tubing. To this end, the coating chamber is supported on a frame 64 upon which are mounted a pair of rollers 66 which engage the upper surface of the tubing, and a third roller 67 which engages the tubing from below (FIGS. 2–3A). The rotational axes of rollers 66 lie in a vertical plane P2 (FIG. 3A), and the rotational axis of roller 67 lies in a vertical plane P3. According to one important feature of the invention, vertical planes P2 and P3 are separated by a distance less than the diameter of rollers 66 or the diameter of roller 67, whichever is greater. Planes P2 and P3 also may be coincident. Limiting the contact region of the rollers with tubing 16 in the manner explained enables the coating chamber to better follow the movement of tubing 16.

The frame 64 is slidably supported on four fixed vertical rods 68 in the illustrated embodiment so that the coating chamber 10 is constrained for vertical rectilinear travel. The coating chamber frame 64 has collars 76 associated with each of the vertical rods 68 and in sliding engagement therewith.

The frame 64 includes a pair of side frame members 98 and a pair of transverse members 100 which form a generally rectangular box about the lower end of the coating chamber 10. The frame 64 further comprises a structure 102 for supporting upper rollers 66 and lower roller 67, and a mechanism for permitting adjustment of the spacing between the upper rollers 66 and the lower roller 67 to accommodate tubing of variable diameter. The structure 102 comprises a pair of lower supports 104 mounted on one of the transverse members 100 for supporting the lower roller 67 at its opposite ends; an upper support member 106 supporting the upper rollers 66 for rotation; and a pair of vertical rods 108 rigidly supported on the lower support members 104 and extending upward to support the upper support member 106. The upper support 106 comprises a central block **106*a* and a transverse member 106*b* which has a pair of vertical bores 110 therein which engage the rods 108 in sliding contact so that the upper rollers 66 may be raised or lowered relative to the lower roller 67. The position of the upper support 106 relative to the lower supports 104 is determined by engagement between a pair of rotatable, vertical threaded rods 96 and a pair of threaded bores 112 in the transverse member 106*b* of the upper support 106. The threaded rods 96 are supported for rotation at their lower ends by the lower supports 104. Thrust bearings 94 extend between the collars 76 on the movable frame and supports 114 on the fixed platform 74, and function as shock absorbers to dampen vibrations and control displacement of the movable frame 64**. Suitable thrust bearings are manufactured by Sealmaster under model number SFT-204.

The fixed rods 68 are supported on an adjustable base 70 (FIG. 2) which permits adjustment of the height and attitude of the coating chamber. In the illustrated embodiment, the base includes four screw jacks 72 positioned at the corners of the base supporting a platform 74 on which the vertical rods 68 are supported. The vertical rods 68 extend upward from lower supports 114 on the platform 74 to upper supports 116 disposed at and attached to the upper ends of vertical beams 117A–117D and 118A–118D (FIGS. 3A and 6). To permit the coating chamber 10 to break away from the adjustable base 70 in the event of a mishap, the screw jacks 72 are attached to the platform 74 by breakable fasteners 92, such as nylon bolts.

Referring to FIGS. 2, 3A and 6, coil springs 119A–119D are positioned around thrust bearings 94 in the positions shown. The springs define central vertical axes 121A–121D which are equidistant from central vertical coating chamber axis C (FIG. 6). The upper ends of springs 119A–119D are held to collars 76 by circular plates 122 and the lower ends of springs 119A–119D are held to platforms 114 by similar circular plates 124. Springs 119A–119D are sufficiently strong to support the entire weight of the apparatus carried by tubing 16, including coating chamber 10, frame 64 and rollers 66 and 67. Thus, the springs counterbalance the weight of chamber 10 and frame 64, as well as the weight of rollers 66 and 67. This is an important feature of the preferred embodiment. Since springs 119A–119D are coupled to frame 64 and base 70 through plates 122 and 124, the springs respond to movement of tubing 16 up and down in vertical plane P and apply forces to coating chamber 10 opposing both the up and down movement of the tubing. Rods 68 confine chamber 10 to vertical movement during normal coating of tubing 16. Thrust bearings 94 act as shock absorbers that damp the oscillations of springs 119A–119D.

Frame 64, springs 119A–19D, and rollers 66 and 67 function as a guide for enabling coating chamber 10 to follow the movement of tubing 16 in plane P during coating of tubing 16. In the event of accidental displacement of tubing 16 to a location remote from linear path 17, breakable fasteners 92, and breakable lines 30 and 36 enable coating chamber 10, frame 64 and rollers 66 and 67 to be carried with tubing 16 to the remote location. As a result, damage to coating chamber 10 and the separation chambers is minimized.

As noted above, to permit rapid changeover from one coating member to another, the illustrated apparatus includes two independent vacuum/supply systems 20 and 22. In accordance with a preferred method of operation, changing the coating operation from one coating material to another is accomplished by disconnecting the coating chamber 10 from one vacuum/supply system, flushing the coating chamber and the vacuum and supply lines 30 and 36, and then connecting the coating chamber 10 to the other vacuum/supply system. The coating chamber 10 remains in place on the tubing 16 throughout the changeover to minimize line down time. The supply line 36 and the vacuum line 30 are preferably both provided with quick-disconnect fittings or other means to facilitate connection and disconnection to and from the respective vacuum/supply systems. The vacuum ports 78 on the respective systems are preferably positioned adjacent one another to reduce the distance that the respective units must be moved during changeovers. That is, the system 20 on the left in FIG. 1 has its vacuum port 78 positioned on the right, whereas the right-hand system 22 has its vacuum port on the left. In each system the support port 79 is positioned on the opposite side from the vacuum port, providing a mirror-image relationship between the two systems.

The system which is not on-line may be cleaned by running a cleaning fluid therethrough. Where the system has been used with a water-based coating material, the cleaning fluid may be water. To facilitate cleaning of the system, a dummy box 80 may be employed to connect the outlet port with the vacuum inlet port of the system.

To permit liquid coating material to be drained from the coating chamber during the changeover, a receptacle 82 is preferably provided adjacent the coating chamber 10, and a drain fitting 84 with a manually operable valve 86 is provided at the bottom of the chamber 10. The coating chamber is preferably flushed with a suitable cleaning fluid therethrough during the changeover.

Each vacuum/supply system may be supported on a movable base 88 which is supported on wheels 90. If desired, the wheels may ride on rails to guide the vacuum/supply apparatus in rectilinear movement in a direction parallel to the tubing line. As indicated by the arrows in FIG. 1, each system is shifted to the left to change from the system on the left to the system on the right.

Figure 11:
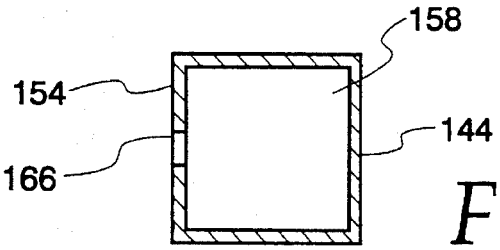
FIG. 11 is a cross-sectional view taken along line 11—11 in FIG. 7.
Figure 9:
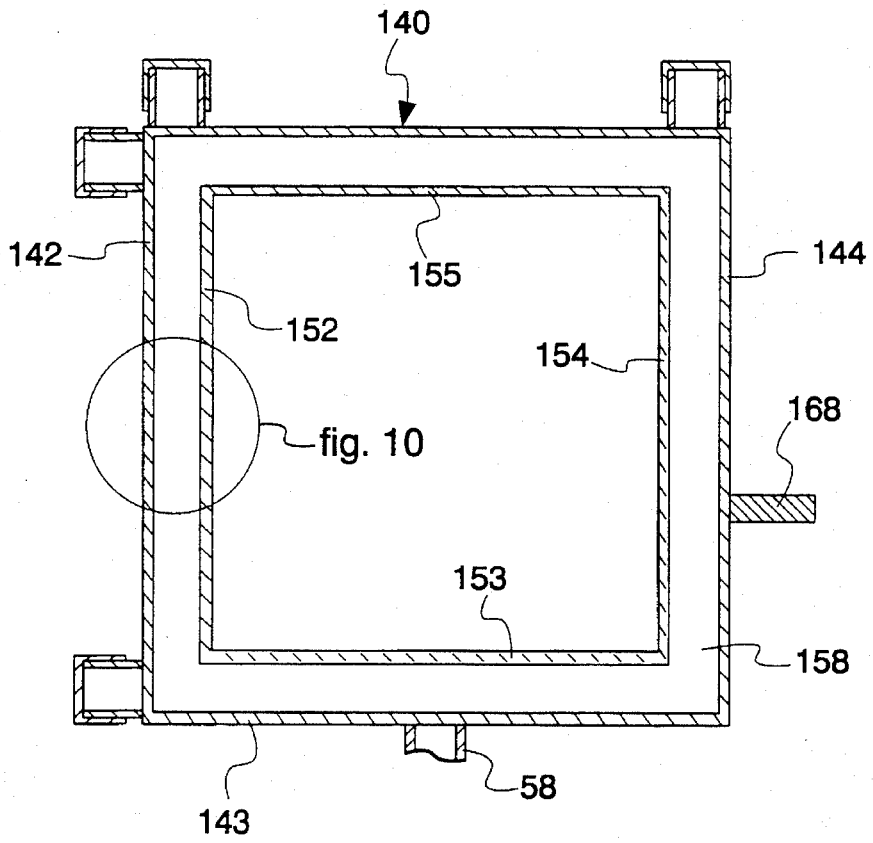
FIG. 9 is a cross-sectional view taken along line 9—9 in FIG. 8.
Figure 10:
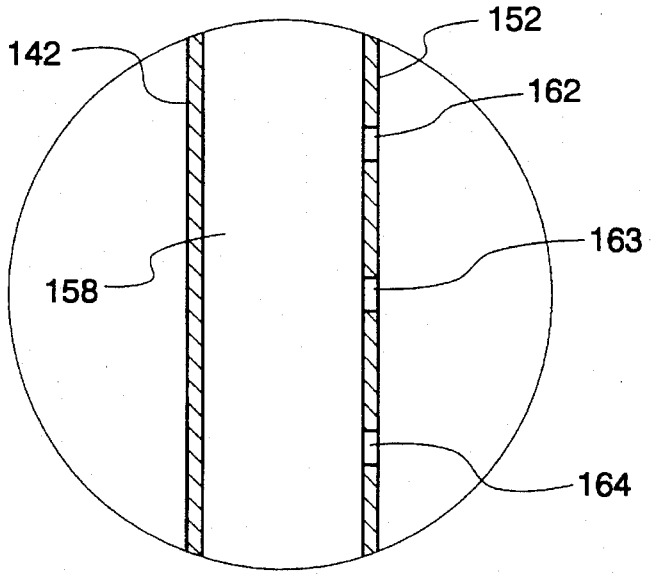
FIG. 10 is an enlarged view of the applicator indicated by the legend "FIG. 10" in FIG. 9.

Referring to FIGS. 7–11, applicator 60 comprises a hollow square cross section tube 140 having legs 142–145 defining inner surfaces 152–155, respectively. Legs 142–145 are equal length and define a square. As shown in FIG. 11, each of legs 142–145 defines a square cross section. Coating fluid is carried through tube 140 in a fluid channel 158. The coating fluid is expelled from tube 140 through circular holes, such as 162–164, located on inner surface 152, and a hole 166 located on inner surface 154. The holes are space equally apart along inner surfaces 152–155. The holes have identical diameters and spacing distances that vary depending on the coating fluid being applied to tubing 16 and the pressure being maintained in tube 140 by supply pump 34. A typical coating fluid is water based acrylic emulsion coating applied through ¼ inch holes (such as 162–164) spaced every ¾ inch center to center. Fluid pressure typically is 5 pounds per square inch above ambient pressure. Tube 140 is mounted in a manner described later by a flange 168. There are advantages to a square applicator tube having a square cross section. Circular holes, such as 162–164, in a planar surface, such as 152 (FIG. 10), present a planar nozzle or orifice. Liquid expressed or extruded through a planar orifice normal to the plane of surface 152 exhibits minimum divergence from geometry and atomization, and thus is more efficiently controlled.

Figure 14:
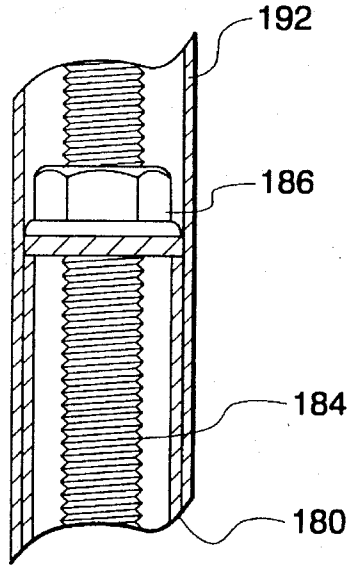
FIG. 14 is an enlarged view of the cutaway portion of the apparatus shown in FIG. 12.
Figure 13:
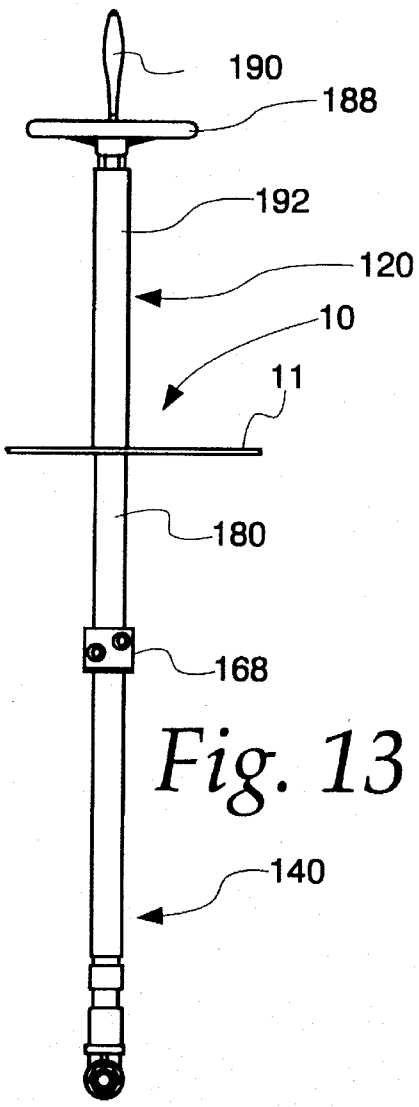
FIG. 13 is a from elevational view of the coating applicator adjustment assembly shown in FIG. 12.
Figure 12:
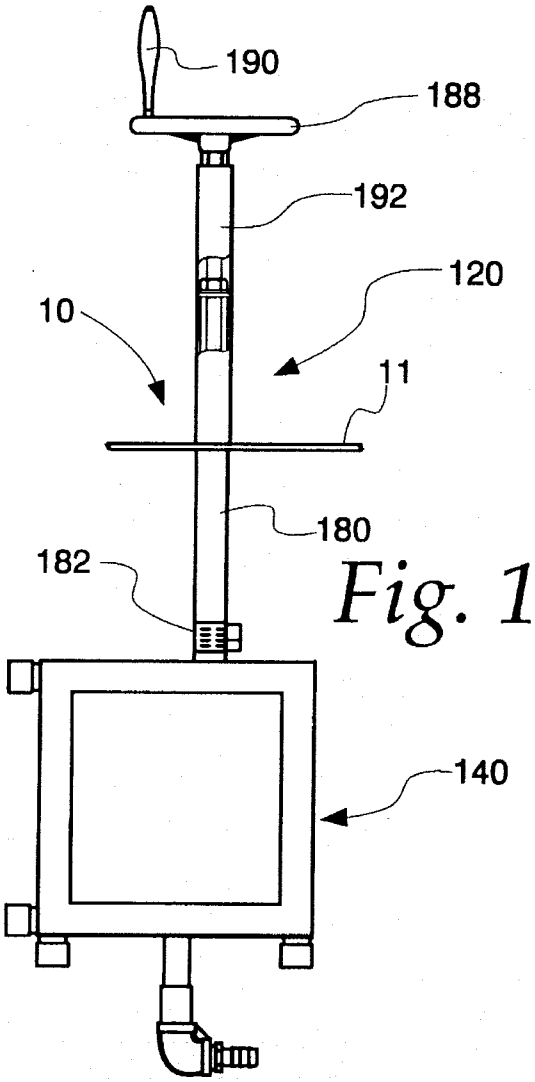
FIG. 12 is a side elevational view of the coating applicator adjustment assembly shown schematically in FIG. 3A.

Referring to FIGS. 12–14, adjustment 120 comprises an inner slide tube 180 terminating in a fork attachment 182 that is fastened to flange 168 of tube 140. A one half inch diameter threaded rod 184 is located inside tube 180. The rod is threaded to a corresponding nut 186 that is attached to the top of tube 180. A five inch diameter handle 188 is connected for rotation to the top of rod 184. The handle is fitted with a hand crank 190 that facilitates rotation of handle 188. Tube 180 and rod 184 are enclosed by an outer one and one eighth inch square tube 192 that is connected to top plate 11 of chamber 10. By turning crank 190, tube 140 can be conveniently raised or lowered within chamber 10 in order to align tube 140 with tubing 16.

Referring to FIG. 3A, tube 140 may be manually adjusted after access is gained through an access door assembly 200. The assembly includes frame members 201 and 202 on which are mounted a conventional door 204. The entire assembly is formed in the sidewall of coating chamber 10. When door 204 is opened, tube 140 may be cleaned, removed or adjusted as needed to accommodate various diameters of tubing 16.

Figure 15:
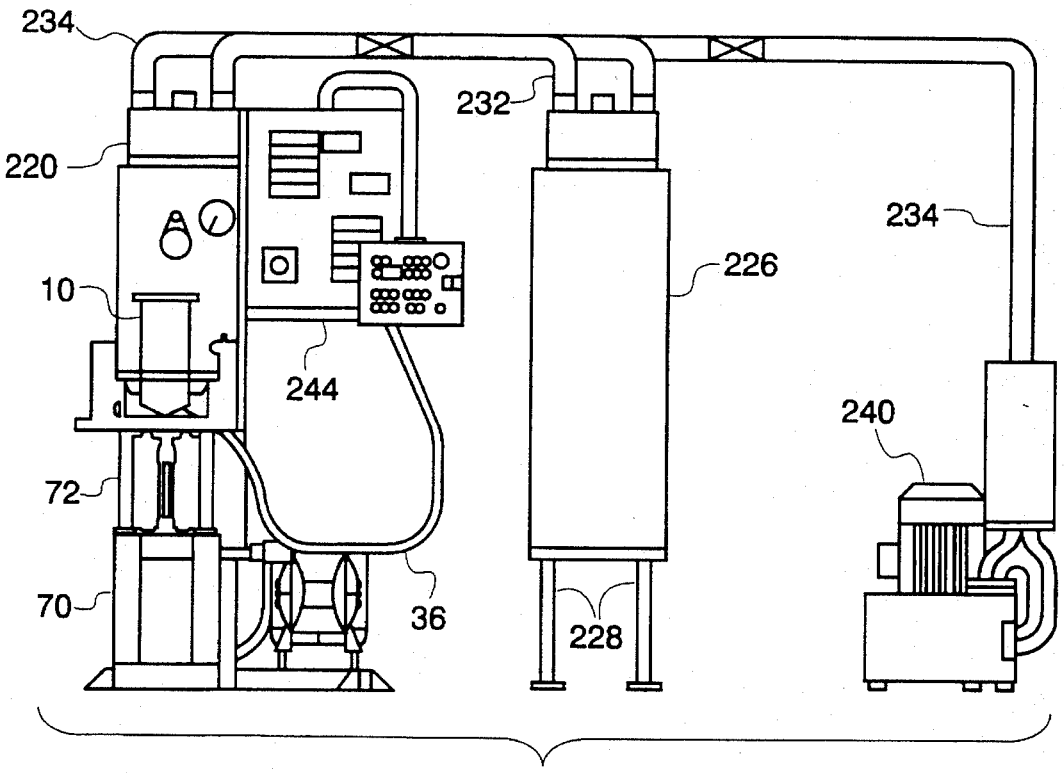
FIG. 15 is a diagrammatic front elevational view of an alternative embodiment of the invention using primary and secondary separation chambers on separate bases.
Figure 16:
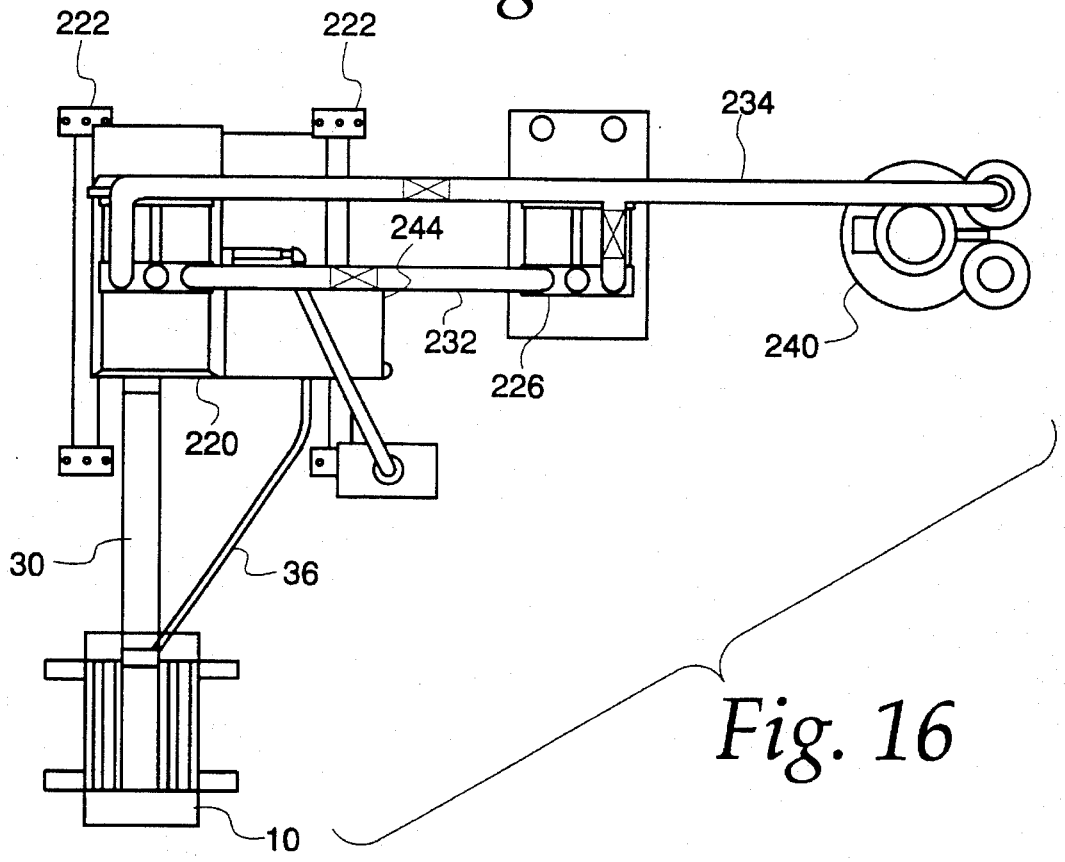
FIG. 16 is a top plan view of the apparatus shown in FIG. 15.

The separation chambers may be arranged on separate spaced bases as shown in FIGS. 15 and 16. A cyclone separator unit 220 is connected to vacuum line 30 in the same manner as separator 24. Cyclone separators offer higher separation efficiency and lower pressure drop than filter separators. Unit 220 may be a model XQ465-9 manufactured by Fisher-Klosterman, Inc. Unit 220 rests on a base 222 as shown. A second filter separator unit 226 is mounted on a separate base 228 displaced from base 222.

Flexible or breakable line 232 connects unit 220 with unit 226. A flexible or breakable line 234 connects unit 220 and unit 226 with the input of a conventional vacuum pump 240. The entire coating process is controlled from a control panel 244.

During coating, pump 240 creates a subatmospheric pressure that draws air through ports 12 and 14 into coating chamber 10. Due to seal 50, more air is drawn into port 14 than port 12, thereby permitting higher vacuum and lower air volume flow rates. This is an important feature because it permits lower horse power operation, conserves energy and reduces the load to separator units 220 and 226. The coating fluid vapor in chamber 10 is drawn through line 30 and into cyclone separator unit 220 where much of the coating fluid in the vapor is removed from the air and recovered. The remaining vapor is drawn into filter separator unit 226 where the remaining fluid is recovered. By maintaining units 220 and 226 on separate bases, the damage to the units is reduced in the event that an accident causes tubing 16 to deviate substantially from linear path 17.

From the foregoing it should be appreciated that the invention provides a novel and improved method for continuous coating of continuously manufactured metal tubing. Those skilled in the art will recognize that the preferred embodiments may be altered and modified without departing from the spirit and scope of the invention pointed out in the following claims:

We claim:

1. Coating apparatus for applying a coating to a length of horizontally oriented metal tubing moving along a linear path concentric with said tubing, said linear path defining a vertical plane, said apparatus comprising:

a coating chamber defining a vertical central axis for applying said coating to said tubing while said tubing is being passed through said chamber along said linear path, said coating chamber comprising an exit port and an entry port through which said tubing passes, a vacuum port for outflow of air from said chamber and a liquid supply port for inflow of liquid coating material;

a reservoir of coating material;

a supply line for carrying coating material from said reservoir to said liquid supply port;

a supply pump for effecting flow of coating material through said supply line and into said coating chamber through said supply port;

a vacuum line connected to said vacuum port for receiving outflow of air from said coating chamber;

a primary separation chamber spaced from said coating chamber for receiving airflow from said vacuum line and effecting separation of air from coating material;

a vacuum pump maintaining subatmospheric pressure in said primary separation chamber so that ambient air flows into said coating chamber through said exit port, then through said vacuum line to said primary separation chamber; and guide means for enabling said coating chamber to follow the movement of said tubing in said vertical plane during coating of said tubing and for carrying said coating chamber with said tubing during accidental displacement of said tubing to a location remote from said linear path, whereby damage to said primary separation chamber and said coating chamber is minimized during accidental displacement of said tubing from said linear path.

2. Apparatus, as claimed in claim 1, wherein said guide means comprises:

a coating chamber base for supporting said coating chamber;

spring means supported on said coating chamber base and coupled to said coating chamber for counterbalancing the weight of said coating chamber;

roller means coupled to said coating chamber for engaging said tubing and for moving said spring means in response to movement of said tubing; and fastening means for releasably connecting said spring means to said base, whereby said fastening means enable said coating chamber to move with said tubing during accidental displacement of said tubing to a location remote from said linear path.

3. Apparatus, as claimed in claim 2, wherein said spring means comprises a plurality of springs located equidistant from said central axis.

4. Apparatus, as claimed in claim 2, wherein said spring means further comprises shock absorber means for damping movement of said spring means.

5. Apparatus, as claimed in claim 3, wherein said shock absorber means comprises at least one thrust bearing.

6. Apparatus, as claimed in claim 2, wherein said spring means are responsive to movement of said tubing up and down in said vertical plane for enabling said spring means to apply forces to said coating chamber opposing both said up and down movement of said tubing, whereby said coating chamber is urged to follow said movement of said tubing.

7. Apparatus, as claimed in claim 1, and further comprising limiting means for confining said coating chamber to vertical movement during said coating of said tubing.

8. Apparatus, as claimed in claim 2, wherein said roller means comprises at least one roller defining a roller diameter and wherein said engagement of said tubing by said roller means is limited to an area along said tubing bounded by first and second vertical planes separated by a distance less than said roller diameter.

9. Apparatus, as claimed in claim 8, wherein said roller means comprises a first roller defining a first diameter and engaging said tubing at a point above said linear path in said first vertical plane and a second roller defining a second diameter and engaging said tubing at a point below said linear path in said second vertical plane, said roller diameter being the larger of said first and second diameters.

10. Apparatus, as claimed in claim 2, and further comprising a primary separation chamber base spaced from said coating chamber base for supporting said primary separation chamber, whereby damage to said primary separation chamber and said coating chamber is minimized during accidental displacement of said tubing from said linear path.

11. Apparatus, as claimed in claim 10, and further comprising:

a secondary separation chamber for receiving outflow from said primary separation chamber during said coating of said tubing; and a secondary separation chamber base spaced from said coating chamber base and from said primary separation chamber base for supporting said secondary separation chamber, whereby damage to said primary separation chamber, said secondary separation chamber and said coating chamber is minimized during accidental displacement of said tubing from said linear path.

12. Apparatus, as claimed in claim 11, wherein said outflow from said primary separation chamber is received by said secondary separation chamber through a flexible tube.

13. Apparatus, as claimed in claim 11, wherein said primary separation chamber is a cyclone separator and wherein said secondary separation chamber is a filter separator.

14. Apparatus, as claimed in claim 1, wherein said coating chamber comprises an applicator surrounding said tubing for applying said coating to said tubing, said guide means enabling said applicator to follow the movement of said tubing in said vertical plane during coating of said tubing.

15. Apparatus, as claimed in claim 14, wherein said applicator has a rectangular cross section and a rectangular shape.

16. Apparatus, as claimed in claim 14, and further comprising screw adjustment means for raising and lowering said applicator without opening said coating chamber.

17. Apparatus, as claimed in claim 14, and further comprising an access door in said coating chamber, whereby said applicator can be manually adjusted to accommodate tubing having different diameters.

18. Apparatus, as claimed in claim 1, wherein said entry port comprises includes a seal for restricting air flow into said entry port so that flow of air into said entry port is more restricted than flow of air into said exit port.

19. Apparatus, as claimed in claim 18, wherein said entry port comprises an entry mask and wherein said exit port comprises an exit mask, said entry mask and said exit mask being selectively adjustable relative to said coating chamber to facilitate centering of said metal tubing in said entry port and said exit port.

20. Apparatus, as claimed in claim 1, wherein said vacuum line and said supply line are flexible.

21. Apparatus, as claimed in claim 1, wherein said vacuum line and said supply line are breakable.

22. Apparatus, as claimed in claim 1, wherein said coating chamber further comprises a manually operable drain which may be maintained in a sealed configuration during coating, and which may be shifted to an open configuration for cleaning of the coating chamber during interruptions in coating operations.

23. A method for applying a coating to a length of horizontally oriented metal tubing moving along a linear path concentric with said tubing and defining a vertical plane comprising in combination the steps of:

passing said tubing along said linear path through an entry port and an exit port of a coating chamber defining a vertical axis;

applying coating material to said tubing in said coating chamber;

drawing air through said entry port and said exit port, through said chamber and through a vacuum line into a separation chamber so that coating material vapor is evacuated from said coating chamber;

removing said coating material vapor from said air in said separation chamber;

enabling said coating chamber to follow the movement of said tubing in a vertical plane as said tubing passes through said coating chamber; and carrying said coating chamber with said tubing during accidental displacement of said tubing to a location remote from said linear path, whereby damage to said separation chamber and said coating chamber is minimized during accidental displacement of said tubing from said linear path.

24. A method, as claimed in claim 23, wherein said step of enabling comprises the step of counterbalancing the weight of said coating chamber resiliently so that said coating chamber follows both the up and down vertical movement of said tubing as said tubing is passed through said coating chamber.

25. A method, as claimed in claim 24, wherein said step of counterbalancing further comprises the step of damping the movement of said coating chamber.

26. A method, as claimed in claim 24, wherein the step of counterbalancing comprises the step of suspending the weight of said coating chamber at points equidistant from said vertical axis.

27. A method, as claimed in claim 24, wherein the step of counterbalancing comprises the step of applying forces to said coating chamber opposing both up and down movement of said tubing, whereby said coating chamber is urged to follow said movement of said tubing.

28. A method, as claimed in claim 23, wherein said step of applying coating material comprises the step of propelling coating material toward said tubing from multiple opposed directions.

* * * * *